United States Patent [19]

Powell et al.

[11] 3,985,551

[45] Oct. 12, 1976

[54] PROCESS FOR REMOVING CARBON FROM URANIUM

[75] Inventors: George L. Powell, Oak Ridge; Cressie E. Holcombe, Jr., Knoxville, both of Tenn.

[73] Assignee: The United States of America as represented by the United States Energy Research and Development Administration, Washington, D.C.

[22] Filed: Feb. 24, 1976

[21] Appl. No.: 660,907

[52] U.S. Cl. ..... 75/84.1 R; 75/84.1 A; 148/132; 252/301.1 R

[51] Int. Cl.[2] ..... C22B 60/02

[58] Field of Search ..... 252/301.1 R; 75/84.1 R, 75/84.1 A; 148/132

[56] References Cited

OTHER PUBLICATIONS

NSA vol. 30, Abstract No. 21669 (Avery, J. G.).

Wilkinson, *Uranium Metallurgy* vol. No. 1 (1962) Intesciences Publishing Co. pp. 210 –239, 618.

*Primary Examiner*—Brooks H. Hunt

*Attorney, Agent, or Firm*—John A. Horan; David S. Zachry; Allen H. Uzzell

[57] ABSTRACT

Carbon contamination is removed from uranium and uranium alloys by heating in inert atmosphere to 700°–1900°C in effective contact with yttrium to cause carbon in the uranium to react with the yttrium. The yttrium is either in direct contact with the contaminated uranium or in indirect contact by means of an intermediate transport medium.

7 Claims, No Drawings

PROCESS FOR REMOVING CARBON FROM URANIUM

BACKGROUND OF THE INVENTION

This invention was made in the course of, or under a contract with the Energy Research and Development Administration. In its broadest form it relates to the removal of carbon contamination from uranium and uranium alloys by reaction with yttrium.

High purity uranium is required for many applications in the nuclear industry. During the course of refining and melting operations, uranium normally picks up carbon from contact with graphite ware and from $CO_2$ and CO evolved from carbonaceous materials at high temperatures. Carbon contamination is present in molten uranium chiefly as dissolved carbon and in solid uranium as both dissolved carbon and uranium carbide inclusions. This carbon contamination causes considerable reduction in tensile strength, ductility, and corrosion resistance of uranium. For purposes of this invention, the term "carbon contamination" refers to total carbon content, regardless of form. Carbon contamination is particularly bothersome in the production of uranium alloys with alloying metals such as niobium, tantalum, vanadium, and titanium. Such alloys are produced by melting the desired amount of alloying metal with the required amount of uranium or uranium alloy. When the metals are melted together, carbon present in the uranium or uranium alloy feed reacts with the alloying metals forming carbides which float to the top of the melt. This carbide formation makes precise control of the alloy composition very difficult; therefore, the lower the level of carbon contamination in the feed materials, the greater is the composition control capability.

PRIOR ART

The carbon contamination problem in uranium and uranium alloys is well known in the prior art. A variety of methods for dealing with the problem has been proposed, some involving the use of gettering metals selected from groups IVB, VB, and VIB of the periodic table such as titanium, zirconium, tantalum, and molybdenum. Several methods for removing carbon contamination from uranium and uranium alloys are described by Walter D. Wilkinson in *Uranium Metallurgy*, Vol. 1, available from Interscience Publishers (New York and London) 1962. According to Wilkinson (pp. 213–214) insoluble carbides may be concentrated in the top of a melt by sonic vibrations, and soluble carbon contamination may be slightly decreased by vacuum melting uranium in a crucible with a tantalum lid. It was not certain however, whether the tantalum actually reduced the carbon level, and, in any case, the carbon contamination level was reduced only about 15% from 16.5 to 14 ppm. Yttrium has been used as a containment material for molten uranium alloys, (Wilkinson, p. 618), however it was not used as a getter for carbon and its ability as a getter was not recognized.

A more expensive and time consuming purification method taught by Wilkinson (238–239) is zone melting, in which a singleturn induction heater is passed slowly over a long solid charge of contaminated uranium to cause localized melting and the concentration of impurities, including carbon, in the ends of the charge which are then cut away. Another method taught by Wilkinson (pp. 238–239) is purification by diffusion, which involves heating uranium in liquid sodium or lithium in a gettering container such as tantalum or thorium. It is taught that this method should be effective for removing oxygen (and possibly carbon and nitrogen), however it is pointed out that the slow rate of diffusion makes this method impractical for any but finely divided uranium. An inexpensive, effective method for removing carbon contamination from both solid and liquid uranium has long been needed.

SUMMARY OF THE INVENTION

It is an object of this invention to provide an inexpensive, highly efficient method for removing carbon contamination (both dissolved carbon and uranium carbide inclusions) from uranium and uranium alloys. It is a further object to provide a process which is effective for uranium and uranium alloys in both the solid and liquid states.

These and other objects are accomplished by providing a method for decreasing the level of carbon contamination in uranium comprising confining said uranium in inert atmosphere in effective contact with yttrium, heating the confined metals to 700°–1900° C for causing carbon from said uranium to react with said yttrium forming a yttrium carbide and recovering uranium reduced in carbon content. Below 700° C, the reaction is impractically slow and above 1900° C, yttrium carbides melt and decompose to yttrium (which readily volatilizes) and a liquid phase rich in carbon which might re-contaminate the uranium.

The contact required in our method is contact effective for causing carbon in the uranium to diffuse to directly contact yttrium and form yttrium carbide. This effective contact is achieved directly by contacting yttrium with molten uranium or indirectly by contacting yttrium with a liquid metal diffusion medium which in turn is in direct contact with uranium (either solid or molten).

DETAILED DESCRIPTION

This invention is a method for decreasing the level of carbon contamination in uranium by using yttrium as a carbon gettering material. While the general method is illustrated with respect to contaminated uranium, it is operable under appropriate conditions for removing carbon from a number of uranium alloys such as U-.75Ti, U-10Mo, U-6Nb, U-7.5Nb-2.5Zr, etc.

For a metal to be an effective getter for removing carbon from uranium it is necessary that the metal react with carbon under the process conditions to form a carbide significantly more stable than uranium carbide. Generally, the more thermodynamically stable the metal carbide compound with respect to uranium carbide, the more effective is the metal for removing carbon contamination. Carbon getters are normally thought to be found in groups IVB, VB, and VIB of the periodic table (Webster's Seventh New Collegiate Dictionary, G. and C. Merriam Co., Springfield, Massachusetts), unlike yttrium, found in group IIIB.

The unexpected efficiency of yttrium as a getter for carbon from uranium is not fully explained by published thermodynamic data. In a 1971 report published by the Molybdenum Corporation of America, Iowa State University Report IS-RIC-5: "Thermochemistry of the Rare Earth Carbides, Nitrides, and Sulfides for Steelmaking", thermodynamic data for the formation of $YC_2$ indicate that yttrium would not getter carbon from uranium by formation of this compound. Another reference, G. V. Samsonov, "High Temperature Compounds of Rare Earth Metals With Nonmetals", Consultants Bureau, New York, 1965, states the $YC_2$ is the most chemically stable compound in the yttrium-carbon system. Based upon these references, the gettering of carbon from uranium by yttrium with the formation of a stable yttrium carbide was most surprising. The specific yttrium carbide stoichiometry of the reaction product is not known. It will be termed yttrium carbide for purposes of this disclosure. It is believed that perhaps other gettering materials are diffusion inhibited and yttrium's effectiveness is a combination thermodynamic effect and kinetic effect.

In order to practice our invention in its broadest form, all that is necessary for removing carbon contamination from uranium is that the contaminated uranium be effectively contacted with yttrium in inert atmosphere (vacuum, noble gas or other non-reactive atmosphere) at a temperature of 700°–1900° C. Under these conditions, carbon from the contaminated uranium reacts with the yttrium forming a yttrium carbide. For purposes of this invention, effective contact is contact effective for achieving the reaction of yttrium with carbon contamination from the uranium. Effective contact may be accomplished directly by contacting a uranium melt with yttrium in any convenient manner, such as by melting the uranium in a yttrium crucible or by adding slugs or turnings of yttrium to the melt. When the yttrium reacts with the carbon, yttrium carbide is formed which floats to the top of the melt where it is easily separable from the uranium (now reduced in carbon contamination level). For example, the yttrium carbide may be skimmed from the top of the melt, the molten uranium may be drained from the bottom of a bottom-pour crucible, or the melt can be allowed to harden and the top layer (which contains the yttrium carbide) may be sawed off. Effective contact is also achievable indirectly such as by contacting uranium (which in this case may be solid or liquid) with a liquid metal intermediate diffusion medium such as a molten alkali metal which is in direct contact with yttrium. Carbon contamination in the uranium migrates through the diffusion medium and is deposited directly on the surface of the yttrium by the formation of yttrium carbide. Other non-contaminating, low-melting metals may be used as intermediate diffusion media at temperatures above their melting points; for example, alkaline earth metals such as calcium, barium and strontium.

When the uranium is effectively contacted with yttrium according to this invention, some diffusion of yttrium into uranium is likely to occur, especially where molten uranium is directly contacted with yttrium. While yttrium contamination may be tolerated within limits in many applications, other uses such as in reactor technology require uranium of higher purity.

A particular advantage to the use of yttrium as a carbon getter is that excess yttrium which diffuses into the uranium is easily removable by various methods such as distillation and oxidation to $Y_2O_3$. For example, yttrium contamination may be removed by melting the uranium and contacting it with $UO_2$. This causes yttrium to be oxidized to $Y_2O_3$, reducing $UO_2$ to elemental uranium. This reaction is carried out conveniently by passing molten uranium (contaminated with yttrium) through a bed of $UO_2$ particles in inert atmosphere at a temperature of about 1200° to 1900° C leaving substantially yttriumfree uranium (less than about 10–100 wt. ppm).

A more convenient way of oxidizing excess yttrium, but which results in a small uranium loss, is to contact molten uranium with oxygen which causes the formation of uranium oxides and $Y_2O_3$ which float to the top of the melt. This step is conveniently carried out immediately after direct yttrium contact with the melt has resulted in the concentration of yttrium carbide at the top of the melt. Then all the carbide and oxides are removable together leaving uranium reduced in carbon content and relatively yttrium-free.

An alternate method of removing yttrium from uranium is to heat the uranium to about 1200°–1400° C which causes a yttrium background vapor pressure of greater than or equal to $10^{-5}$ torr. Under vacuum or flowing inert gas, yttrium present in the uranium is vaporized leaving substantially yttrium-free uranium behind (less than about 10 wt. ppm). This vaporization is significantly accelerated if the yttrium vapor is pumped away, or is collected on a sorbitive surface such as carbon (which should be previously heated in a vacuum to remove residual CO and $CO_2$ which might contaminate the uranium). The ease of removing yttrium from uranium makes yttrium very attractive as a carbon getter. In general, metals from groups IVB, VB, and VIB have high solubilities in uranium and very low vapor pressures. These metals form oxides which are either less stable than uranium oxides or only slightly more stable. Hence it would be extremely difficult to remove these metals from uranium by oxidation or distillation. To demonstrate the unexpected effectiveness of yttrium as a carbon getter, the following table is presented summarizing an experimental comparison of yttrium with titanium and zirconium (normally thought to be very effective carbon getters). As indicated in the table, yttrium is a much better carbon getter than titanium and at least as good as zirconium at low temperatures.

TABLE I

| Gettering Material | Temperature at Test °C | Time of Test Sec. × $10^3$ | Amount of Carbon in Uranium Before Test (PPM) | Amount of Carbon in Uranium After Test (PPM) | Percent Carbon Removed |
|---|---|---|---|---|---|
| Titanium | 900 | 90 | 796 | 582 | 26.8 |
| Titanium | 1200 | 10 | 796 | 757 | 4.9 |
| Titanium | 1200 | 10 | 796 | 532 | 33.2 |
| Titanium | 1200 | 10 | 796 | 582 | 26.8 |
| Titanium | 1300 | 7 | 297 | 168 | 43.4 |
| Titanium | 1300 | 7 | 297 | 190 | 36.0 |
| Zirconium | 850 | 90 | 633 | 323 | 49.0 |
| Zirconium | 900 | 90 | 633 | 395 | 37.6 |
| Zirconium | 1000 | 180 | 633 | 395 | 37.6 |
| Yttrium | 1000 | 90 | 796 | 400 | 49.7 |
| Yttrium | 1200 | 4 | 796 | 30 | 96.2 |

TABLE I-continued

| Gettering Material | Temperature at Test °C | Time of Test Sec. × $10^3$ | Amount of Carbon in Uranium Before Test (PPM) | Amount of Carbon in Uranium After Test (PPM) | Percent Carbon Removed |
|---|---|---|---|---|---|
| Yttrium | 1300 | 7 | 297 | 31 | 89.6 |

The tests were conducted as follows: A 3 mm. cube of reactor grade uranium contaminated with carbon was placed in a niobium-1 wt.% zirconium crucible having an interior diameter of about 20 mm. The crucible was heated to 200° C and molten lithium was added to cover the uranium cube to a depth of about 5 mm. The crucible was then covered with a niobium-1 wt.% zirconium fitted on the inner side with a rod of gettering material (either yttrium, zirconium, or titanium) such that the gettering material contacted the molten lithium but not the uranium cube. After assembly, the surface area of the gettering material contacting the lithium was the same in all cases, 100 sq. mm. The gettering material and the uranium were separated by about 3 mm. of lithium. The covered crucible was cooled and transferred to the evacuated chamber of an electron beam welder. The chamber and covered crucible were further evacuated to $1 \times 10^{-3}$ MPa pressure and the lid was sealed to the crucible with an electron beam weld. The sealed capsule was heated to the specified temperature for the specified time. After the capsule was cooled to room temperature, the lid was removed and the uranium was recovered and analyzed with a carbon analyzer and optical metallography.

EXAMPLES

The following examples are presented to illustrate preferred operable modes for carrying out the method of this invention. The process conditions are not necessarily optimized. These examples are for purposes of illustration and are not intended to be limiting, the invention being limited only by the claims. While the examples demonstrate the use of yttrium as a carbon getter, scandium and the rare earth metals (particularly monocarbide formers such as cerium and praseodymium) are contemplated as equivalents of yttrium in this method and may be substituted for yttrium with appropriate process modifications.

EXAMPLE I

This mode is preferred for temperatures below 1132° C where the uranium is not melted. In a covered bottom-pour tungsten or niobium crucible lined with a CaO or MgO ceramic liner, 1000 kg. of uranium turnings or scrap containing 400–800 wt. ppm of carbon are heated with a metallic diffusion medium of alkali or alkaline earth metal, preferably sodium, lithium or calcium, to 1100° C in inert atmosphere or vacuum and held for 2 hours to allow carbon to diffuse to the yttrium rod. In this temperature range the diffusion medium is molten and lies above the denser uranium, which melts at about 1132° C. The heating rate is not critical. The crucible cover is equipped with a yttrium getter rod or plate which extends downwardly into the crucible, contacting the diffusion medium without directly contacting the uranium metal. The getter rod may be pure yttrium or a non-contaminating alloy such as Y-Mg. There should be sufficient molten diffusion medium in the crucible to completely contact the uranium as well as the getter rod. The amount of yttrium immersed in the molten diffusion medium should be about 1–4 kg.

In order to selectively remove the uranium from the crucible at the end of the run, the temperature is raised to 1200° C to melt the uranium. The bottom-pour crucible should be equipped with a valve means such as a ceramic draw plate, to allow the uranium to be drained from the crucible leaving the diffusion medium behind. At the end of the run, the uranium is selectively drained as much as possible. The crucible is cooled under an inert gas purge and is ready for another run. The getter rod is inspected for excess carbon content and replaced if necessary. The diffusion medium is reusable in subsequent runs. If necessary, any residual diffusion medium remaining with the uranium may be boiled away by melting the uranium at 1200° C in a vacuum of about $10^{-2}$ torr to cause the diffusion medium to evaporate.

Examples II, III, and IV demonstrate direct contact between the uranium and the yttrium followed by subsequent yttrium removal.

EXAMPLE II

Four kg. of yttrium is heated with 2000 kg. of carbon-contaminated uranium (800 wt. ppm carbon) in a vacuum (about $10^{-4}$ torr or less) or inert atmosphere in a carbon-free furnace for example, a conventional-type vacuum induction furnace with carbon susceptors. The metals are heated in a carbon-free ceramic or ceramic coated crucible such as MgO, CaO, $Y_2O_3$, $ZrO_2$, etc. to 1200°–1400° C at a rate of 300°–500° C/hr. and held for at least about 30 minutes to 2 hours, and cooled. The heating and cooling rates are not critical. The molar amount of yttrium must exceed the molar amount of carbon in the uranium and should be at least 0.2 wt.% of the total charge.

During heating, carbon in the uranium reacts with yttrium to form yttrium carbide which floats to the top of the melt (drosses off). Upon cooling, the metal forms into an ingot and the yttrium carbide is concentrated at the top surface. The top surface is sawed off leaving relatively carbon-free uranium, now 10–50 wt. ppm in carbon and 1000–1800 wt. ppm in yttrium.

If desired, yttrium may be removed from the recovered uranium by melting the ingot and passing the molten metal through a bed of uranium oxide to oxidize the yttrium to $Y_2O_3$ and reduce the uranium oxide to uranium. For example, a uranium ingot containing 1000–1800 wt. ppm yttrium is placed in a carbon-free, bottom-pour ceramic crucible atop a bed of uranium oxide, such as $U_3O_8$, etc. The crucible is heated to above the melting point of the ingot, about 1132° C, and the molten metal drains through the bed, slowly exiting the bottom of the crucible through a drip plug, such as porous ceramic plug of material wet by uranium such as NbC. $Y_2O_3$ remains in the bed. The uranium drips into a ceramic catch mold; for example, MgO. The uranium oxide bed is usable for subsequent runs until more than about 50% of the oxide has been reduced. The yttrium level in the uranium is now reduced to 10–100 wt. ppm.

EXAMPLE III

An alternative method for removing yttrium from the carbonfree uranium produced in Example II is by distillation in vacuum or inert gas. A 1000 kg. uranium ingot containing 1000–1800 wt. ppm yttrium is heated in an inert atmosphere (preferably a vacuum of at least $10^{-4}$ torr) to 1200°–1400° C in an open ceramic crucible such as MgO. A carbon plate (previously outgassed at 1900° C for 60 minutes in a vacuum of $10^{-7}$ torr) is mounted above the crucible supported by refractory metal braces (such as tungsten). The carbon may be any conventional form, preferably activated carbon.

Upon heating, yttrium in the uranium ingot evaporates and reacts with the carbon surface forming a yttrium carbide. The carbon plate acts as a yttrium sink or pump to cause the further evaporation of yttrium. In this temperature range the vapor pressure of yttrium is about $10^{-5}$ torr and the vapor pressure of uranium is about $10^{-7}$ torr. Above the 1400° C, uranium has a vapor pressure greater than $10^{-5}$ torr and significant amounts would be vaporized. The uranium should be heated for sufficient time to remove most of the yttrium. After about 2 hours, the yttrium content within the uranium is reduced to 10–50 wt. ppm.

EXAMPLE IV

This example demonstrates the removal of yttrium from a uranium ingot by oxidation with gaseous oxygen. Yttrium and uranium are melted together as in Example II in inert atmosphere to cause yttrium carbide to float to the top of the melt. While the metal is still molten, a lance (tungsten for example) is inserted into the melt and an argon-oxygen blend is passed through the melt for about 5 minutes. The oxygen content of the mixture is not critical and the preferred range is 5 to 25 vol. % oxygen. The lance is withdrawn and the melt remains molten for an additional 20 minutes to allow $Y_2O_3$ and uranium oxides to float to the top. The metal is then cast into a suitable mold and the top surface, which contains the yttrium carbide and oxides is sawed off. The remaining uranium has 10–50 wt. ppm yttrium.

What is claimed is:

1. A method for decreasing the level of carbon contamination in uranium comprising:
   a. confining said uranium in inert atmosphere in effective contact with yttrium
   b. heating the confined metals to 700°–1900° C for causing carbon from said uranium to react with said yttrium forming yttrium carbide, and
   c. recovering uranium reduced in carbon contamination level.

2. The method of claim 1 wherein said effective contact is provided indirectly by directly contacting said uranium with liquid metal diffusion medium, said diffusion medium being in direct contact with said yttrium.

3. The method of claim 2 wherein said liquid metal diffusion medium is selected from the group of alkali metals and alkaline earth metals.

4. The method of claim 1 wherein said effective contact is provided directly by melting said uranium in direct contact with yttrium whereby yttrium carbide concentrates at the top of the molten uranium, allowing the molten uranium to harden, and thereafter recovering uranium reduced in carbon content.

5. The method of claim 4 further comprising after yttrium carbide concentrates at the top of said molten uranium, contacting the molten uranium with a gaseous stream comprising oxygen for oxidizing excess yttrium to form yttrium oxide which concentrates at the top of said molten uranium.

6. The method of claim 4 further comprising after recovering uranium reduced in carbon content, melting the recovered uranium in contact with uranium oxide for oxidizing excess yttrium to yttrium oxide, and thereafter recovering uranium reduced in yttrium content.

7. The method of claim 4 further comprising after recovering uranium reduced in carbon content, confining the recovered uranium in inert atmosphere in the presence of outgassed carbon, heating the recovered uranium to 1200°–1400° C for causing excess yttrium to evaporate and be sorbed by the carbon, and recovering uranium reduced in yttrium content.

* * * * *